US005452907A

United States Patent [19]

Meibock et al.

[11] Patent Number: 5,452,907

[45] Date of Patent: Sep. 26, 1995

[54] SKATE WITH ADJUSTABLE BASE AND FRAME

[75] Inventors: Antonin A. Meibock, Cleveland, Ohio; John E. Svensson, Seattle, Wash.

[73] Assignee: K-2 Corporation, Vashon, Wash.

[21] Appl. No.: 120,629

[22] Filed: Sep. 13, 1993

Related U.S. Application Data

[63] Continuation-in-part of Ser. No. 94,576, Jul. 19, 1993.

[51] Int. Cl.[6] ..... A63C 17/06

[52] U.S. Cl. ..... 280/11.22; 280/11.26; 280/11.3

[58] Field of Search ..... 280/11.22, 11.27, 280/11.28, 11.26, 11.3, 11.32, 11.31

[56] References Cited

U.S. PATENT DOCUMENTS

| | | | |
|---|---|---|---|
| 310,923 | 1/1885 | Wardwell . | |
| D. 315,941 | 4/1991 | Olson et al. | D21/226 |
| D. 321,393 | 11/1991 | Olson et al. | D21/226 |
| D. 323,540 | 1/1992 | Graham | D21/225 |
| D. 324,713 | 3/1992 | Rubin | D21/226 |
| D. 327,360 | 6/1992 | Graham | D2/276 |
| D. 327,565 | 7/1992 | Graham | D2/275 |
| D. 334,225 | 3/1993 | Graham | D21/226 |
| 593,278 | 11/1897 | Moulton | 280/11.23 |
| 700,377 | 5/1902 | Sakrzewski . | |
| 829,900 | 8/1906 | Shelmire | 280/11.2 |
| 916,289 | 3/1909 | Fitzgerald | 280/11.22 |
| 1,034,649 | 8/1912 | Rice | 280/11.23 |
| 1,355,680 | 10/1920 | McLean | 280/11.3 |
| 1,527,840 | 2/1925 | Chomin | 280/11.22 |
| 1,539,445 | 5/1925 | Van Buuren | 280/11.23 |
| 1,607,103 | 11/1926 | Sesby | 280/11.23 |
| 1,801,205 | 4/1931 | Mirick | 280/11.22 |
| 1,868,548 | 7/1932 | Turner . | |
| 2,118,892 | 5/1938 | Mays | 280/11.3 |
| 2,120,987 | 6/1938 | Murray | 280/11.3 |
| 2,147,455 | 2/1939 | Murray | 280/11.3 |
| 2,218,209 | 10/1940 | Marshall | 280/11.19 |
| 2,290,523 | 7/1942 | Bauer . | |
| 2,362,824 | 11/1944 | Hueston . | |
| 2,644,692 | 7/1953 | Kahlert | 280/11.22 |
| 2,868,553 | 1/1959 | Rieckman | 280/11.27 |
| 2,909,375 | 10/1959 | Warner | 280/11.2 |
| 3,387,852 | 6/1968 | De Sarro | 280/11.26 |
| 3,767,220 | 10/1973 | Peterson | 280/11.2 |
| 3,901,520 | 8/1975 | McMahan | 280/7.13 |
| 3,963,252 | 6/1976 | Carlson | 280/11.22 |

(List continued on next page.)

FOREIGN PATENT DOCUMENTS

| | | | |
|---|---|---|---|
| 9211908 | 7/1992 | WIPO | 280/11.22 |

*Primary Examiner*—Mitchell J. Hill
*Assistant Examiner*—Carla Mattix
*Attorney, Agent, or Firm*—Christensen, O'Connor, Johnson & Kindness

[57] ABSTRACT

A skate (10) having a frame (14) that is adjustable with respect to the base (18) of the skate is disclosed. The base includes first and second rims (36, 38) and first and second base fasteners (44). The first and second rims form first and second transverse slots (32, 34), respectively. The first base fastener is transversely slidable within the first transverse slot. The second base fastener is slidable within the second transverse slot. The frame is coupled to the base and has first and second longitudinal slots (30) and first and second frame fasteners (42). The first and second frame fasteners are slidably engaged within the first and second longitudinal slots, respectively. The first and second frame fasteners engage with the first and second base fasteners, respectively. The first and second transverse slots each include a narrow slot portion (56) and a wide slot (58) portion having a greater width than the narrow slot portion. The narrow slot portion is centered below the wide slot portion. The first and second base fasteners include head portions (50) that are nonrotatably engaged within the wide slot portions of the first and second transverse slots, respectively. With this construction the frame can be slid from side to side, rotated, or slid from front to back with respect to the base of the skate as desired by the skater.

23 Claims, 5 Drawing Sheets

U.S. PATENT DOCUMENTS

| | | | |
|---|---|---|---|
| 3,999,772 | 12/1976 | Brennan | 280/11.23 |
| 4,003,582 | 1/1977 | Maurer | 280/11.2 |
| 4,108,451 | 8/1978 | Scheck, Sr. | 280/11.2 |
| 4,275,895 | 6/1981 | Edwards | 280/11.2 |
| 4,345,774 | 8/1982 | Poe et al. | 280/11.19 |
| 4,351,537 | 9/1982 | Seidel | 280/11.12 |
| 4,385,456 | 5/1983 | Livernois et al. | 36/115 |
| 4,418,929 | 12/1983 | Gray | 280/11.23 |
| 4,492,385 | 1/1985 | Olson | 280/7.13 |
| 4,654,985 | 4/1987 | Chalmers | 36/50 |
| 4,657,265 | 4/1987 | Ruth | 280/7.13 |
| 4,666,169 | 5/1987 | Hamill et al. | 280/11.23 |
| 4,718,181 | 1/1988 | Olivieri | 36/119 |
| 4,892,332 | 1/1990 | Jennings | 280/842 |
| 4,898,403 | 2/1990 | Johnson | 280/842 |
| 4,909,523 | 3/1990 | Olson | 280/11.2 |
| 4,932,675 | 6/1990 | Olson et al. | 280/7.13 |
| 4,943,072 | 7/1990 | Henig | 280/112 |
| 4,943,075 | 7/1990 | Gates | 280/842 |
| 4,964,229 | 10/1990 | Laberge | 36/93 |
| 4,988,122 | 1/1991 | Saunders | 280/841 |
| 5,028,058 | 7/1991 | Olson | 280/11.22 |
| 5,046,746 | 9/1991 | Gierveld | 280/11.22 |
| 5,048,848 | 9/1991 | Olson et al. | 280/11.22 |
| 5,052,701 | 10/1991 | Olson | 280/11.2 |
| 5,067,736 | 11/1991 | Olson et al. | 280/11.2 |
| 5,068,956 | 12/1991 | Malewicz | 29/437 |
| 5,069,462 | 12/1991 | Murga | 280/23 |
| 5,092,614 | 3/1992 | Malewicz | 280/11.22 |
| 5,129,663 | 7/1992 | Soo | 280/7.14 |
| 5,143,387 | 9/1992 | Colla | 280/11.2 |
| 5,171,032 | 12/1992 | Dettmer | 280/11.2 |
| 5,171,033 | 12/1992 | Olson et al. | 280/11.22 |
| 5,184,834 | 2/1993 | Yu | 280/11.26 |
| 5,190,301 | 3/1993 | Malewicz | 280/11.22 |
| 5,340,132 | 8/1994 | Malwicz | 280/11.3 |

SKATE WITH ADJUSTABLE BASE AND FRAME

This application is a continuation-in-part of copending application Ser. No. 094,576, filed Jul. 19, 1993, now pending, the filing date of which is claimed herein by reference.

FIELD OF THE INVENTION

This invention relates to skates, and in particular, to in-line roller skates having frames that are adjustable relative to the skate bases.

BACKGROUND OF THE INVENTION

Skaters' feet are as diverse as their preferences for foot positioning. Some would prefer to have their ice skate blade or in-line skate wheels in a toe-out position, while others would prefer a toe-in position. Certainly, other skaters would prefer an alignment between the two extremes. Other preferences relate to the forward or rearward positioning of the wheels or blade with respect to the skate shoe. Optimal positioning of the foot relative to the wheels or blade depends on many factors including the shape and natural positioning of the individual foot, the use to which the skate will be placed, the ability of the skater, and personal preferences. For example, a skater using an in-line skate for alpine training may wish to position the frame (that holds the wheels) forward relative to the skate shoe or boot. A skate racer may wish to adjust the toe-in or toe-out and/or forward positioning of the frame relative to the boot for optimal forward thrust.

Skates have been developed that partially allow some of the above-described adjustments. However, limitations on desirable adjustments and the total lack of some forms of adjustment are inherent in the design of the prior art skates. For example, U.S. Pat. No. 5,046,746 issued to Gierveld ("the Gierveld patent") discloses a skate including a shoe with attachment screws projecting from its soleplate or base that engage slots in the skate frame (see FIG. 4 of the Gierveld patent). The rear of the shoe is mounted to the frame through a slot extending transverse to the longitudinal axis of the skate (see FIG. 7 of the Gierveld patent). This rear slot allows some lateral adjustment, but the length of the slot is limited by the width of that part of the frame. The front mounting assembly does provide some lateral adjustment by using an eccentric washer in the oversize longitudinal slot. However, the limits of this adjustment are narrowly dictated by the slot and the frame. More than minor lateral adjustments are not possible.

Another inherent limitation of the skate disclosed in the Gierveld patent is its inability to accommodate longitudinal adjustment of the shoe relative to the frame. FIG. 8 of the Gierveld patent illustrates the adjustability of the front frame attachment. The longitudinal slot is provided to allow for skate shoes of various sizes with the same frame. However, as mentioned above, forward/rearward adjustment is restricted by the rear transverse slot. Thus, longitudinal adjustments of the frame relative to a particular shoe or boot are not provided at all.

Because of the limitations of even the most adjustable current designs, the present invention was developed. The skate base-to-frame mounting system of the present invention effectively overcomes the adjustment limitations inherent in prior skates and provides a skater with greater options for comfort, performance, ability, and preferred skating style.

SUMMARY OF THE INVENTION

The present invention overcomes the limitations inherent in the prior art skates by providing a skate including a base and a frame. The base has a first oblong rim and first and second base fasteners. The first rim forms a first transverse slot. The first base fastener is slidable within the first transverse slot. The first and second base fasteners are longitudinally spaced apart. The frame is coupled to the base and has first and second frame fasteners adopted to engage the first and second base fasteners, respectively. Tight engagement of the base fasteners to the frame fasteners precludes sliding of the first base fastener within the first transverse slot.

Preferably, the frame also includes first and second brackets having first and second longitudinal slots, respectively. The first and second frame fasteners are engaged to the first and second longitudinal slots. The base also includes a second oblong rim that forms a second transverse slot longitudinally spaced from the first transverse slot. The second base fastener is slidable within this second transverse slot. The first and second transverse slots each include a narrow slot portion and a wide slot portion having a greater width than the narrow slot portion. The narrow slot portion is centered below the wide slot portion. The first and second base fasteners include head portions that are nonrotatably engaged within the wide slot portions of the first and second transverse slots, respectively.

As one aspect of the preferred embodiment of the invention, the base further includes a separate slotted plate of material disposed within each of the first and second transverse slots. This separate slotted plate forms at least part of the narrow portions of the transverse slots. The head portions of the base fasteners are disposed on the slotted plates. The slotted plates are stronger than the surrounding material, such that the head portions of the base fasteners are retained within the transverse slots and deformation of the slots is prevented.

Another aspect of the preferred form of the invention includes a cross-ribbed support structure projecting from the bottom of the base. The support structure increases the torsional stiffness of the base. The base also includes first and second ridges projecting from the bottom of the base. The first and second ridges form the first and second rims, respectively.

As an alternate embodiment of the invention, the skate includes a base having first and second longitudinal slots and first and second base fasteners. The first base fastener is slidable within the first longitudinal slot and the second base fastener is slidable within the second longitudinal slot. The frame has first and second transverse slots and first and second frame fasteners slidably engaged within the first and second transverse slots, respectively. The first and second frame fasteners are engaged with the first and second base fasteners, respectively.

Preferably, the first and second longitudinal slots of this alternate embodiment each include a narrow slot portion and a wide slot portion having a greater width than the narrow slot portion. The narrow slot portion is centered below the wide slot portion. The first and second base fasteners include head portions that are nonrotatably engaged within the wide slot portions of the first and second longitudinal slots, respectively.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

Figure 1:
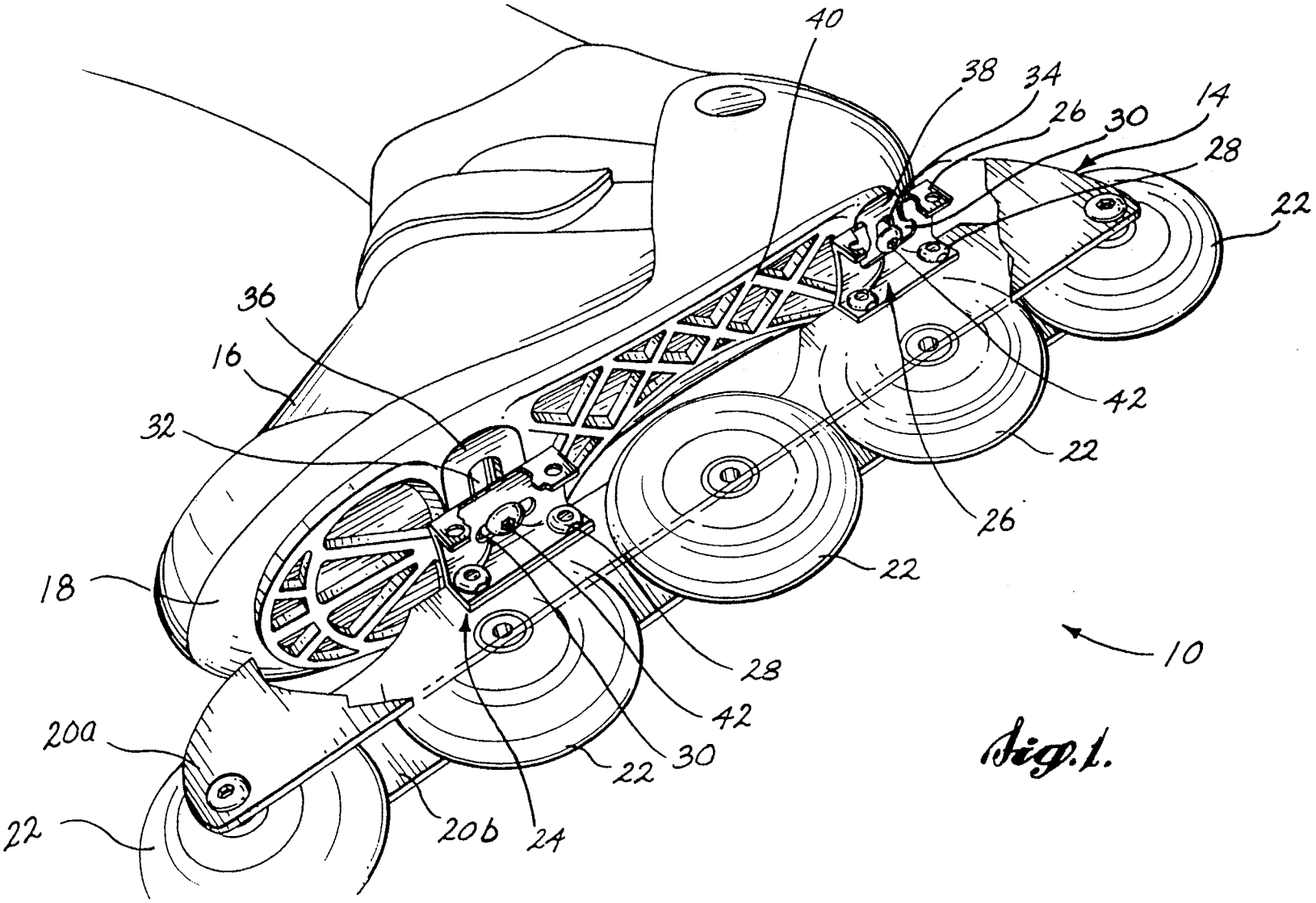
FIG. 1 is a perspective view of one embodiment of the in-line skate of the present invention illustrating the connection of the frame to the base of the skate.

Referring to FIG. 1, a skate 10 is shown that includes a shoe 12 and a frame 14. As will be described herein below, frame 14 is adjustable relative to shoe 12 laterally and longitudinally to provide the skater with the desired positioning of frame 14. Shoe 12 preferably includes a shoe upper 16 and a shoe base 18. Shoe upper 16 is formed of soft material, such as leather or a synthetic weave or a combination of both. Shoe base 18 is preferably constructed of a polymeric material with fiber reinforcement. Alternatively, most any other upper shoe construction could be used, such as a skate boot with a hard shell and soft liner within the shell.

Frame 14 includes rails 20, wheels 22, and forward and rearward brackets 24 and 26. Rails 20 are preferably constructed of a graphite composite. Rails 20 lie in parallel vertical planes that are perpendicular to base 18 of shoe 12. Preferably, rails 20 are adapted to secure five wheels 22 lying in an intermediate vertical plane between rails 20, although a lesser or greater number of wheels is also considered to be within the scope of this invention. Rails 20 are connected to forward and rearward brackets with rail fasteners 28. For example, left rail **20*a* is secured to forward bracket 24 with two rail fasteners 28 extending through holes bored just below the upper forward edge of rail 20*a*. Other numbers of fasteners could alternatively be used. Rail fasteners 28 can also be any standard fastener that adequately secures rails 20 to brackets 24 and 26. As another alternative, rails 20 and brackets 24 and 26 could be one piece such that rail fasteners 28 are not needed. The specific configuration of rails 20 and brackets 24 and 26 could also be varied as long as the primary purpose of providing multiway adjustable mounting to base 18** is provided.

Brackets 24 and 26 have upside-down U-shaped cross sections. As explained above, the legs are attached to rails 20 with rail fasteners 28. The top portions of brackets 24 and 26 lie in horizontal planes parallel to portions of base 18. Each of brackets 24 and 26 has a bracket slot 30 running in a longitudinal direction or, in other words, parallel to rails 20. Bracket slots 30 allow for longitudinal adjustment of frame 14 relative to base 18.

Base 18 also includes forward and rearward base slots 32 and 34. Base slots 32 and 34 extend in transverse directions, generally perpendicular to the direction of bracket slots 30. Forward base slot 32 is formed by a forward ridge 36 that extends across almost the entire width of base 18 beneath the portion of shoe 12 that holds the ball of the foot above base 18. Forward ridge 36 projects below the remainder of base 18 such that no interference with forward bracket 24 is allowed other than with forward ridge 36. Forward ridge 36 has an elongated oval shape with rounded ends and a flat bottom surface parallel to the upper portion of forward bracket 24. A rearward ridge 38 is disposed under the heel of the foot of the skater and projects downwardly from base 18. Rearward ridge 38 is similar in shape and function to forward ridge 36 and forms rearward base slot 34. Rearward ridge 38 is not as wide as forward ridge 36, since that portion of the base is narrower. Rearward base slot 34 is parallel to forward base slot 32. The length of forward and rearward base slots 32 and 34 could alternatively be changed as could their transverse orientation. Rearward base slot 34 could even be extended such that greater rearward than forward adjustment is allowed. In the preferred embodiment, the horizontal plane of the bottom surface of rearward ridge 38 is spaced further above wheels 22 than the horizontal plane of the bottom surface of forward ridge 36.

Base support ribs 40 are also illustrated in FIG. 1. Base support ribs 40 provide structural support between rearward ridge 38 and forward ridge 36. Base support ribs 40 also provide structural support in front of forward ridge 36. Because of the unique cross-ribbed structure of base support ribs 40, torsional, longitudinal, and lateral support is provided for base 18 while weight is reduced. Base support ribs 40 will be discussed in more detail in connection with FIG. 4.

Figure 2:
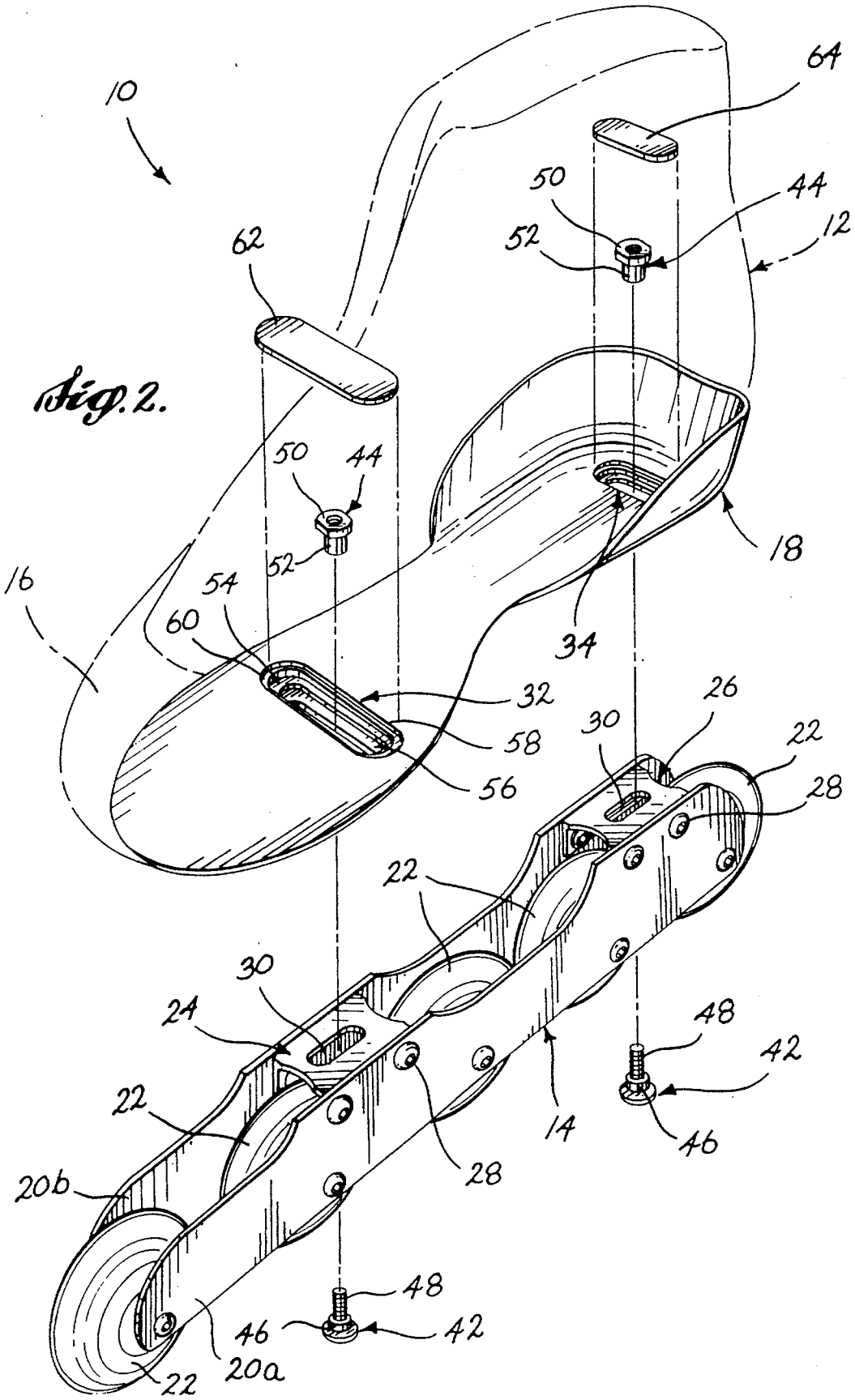
FIG. 2 is an exploded perspective view of one embodiment of the skate of the present invention.
Figure 3:
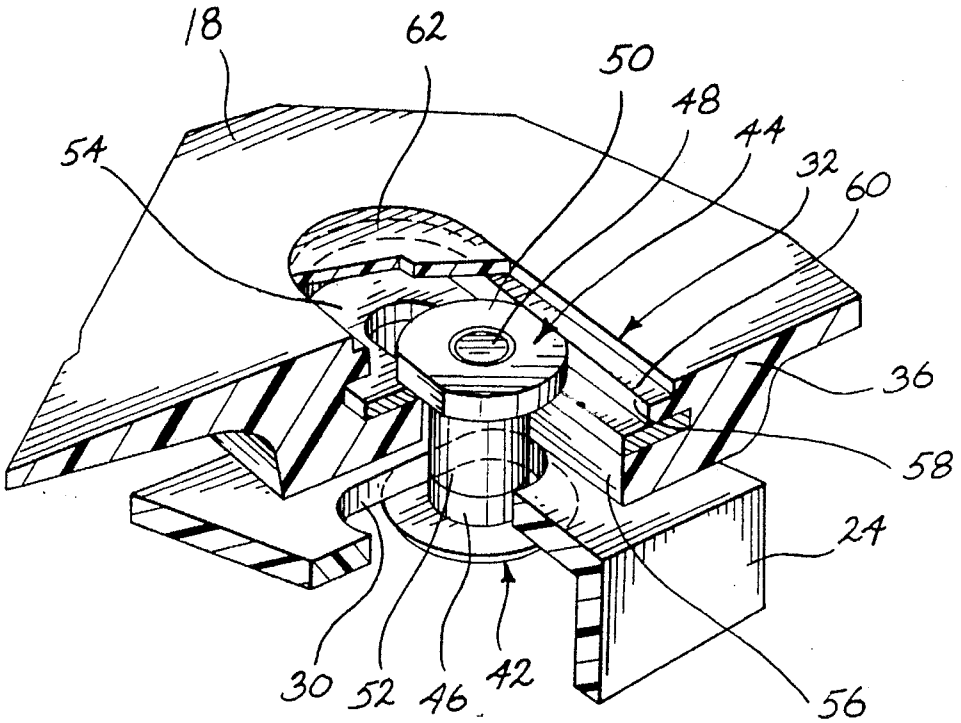
FIG. 3 is a perspective view illustrating cutaway portions of the skate base and frame of FIGS. 1 and 2 to show the interconnection between the two.

Referring now to FIGS. 2 and 3, the assembly of skate 10 will be discussed. Frame 14 is attached to base 18 with frame fasteners 42 and base fasteners 44. Frame fasteners 42 may be screws with fastener shoulders 46 and threaded shafts 48. Two such frame fasteners 42 are preferably used, one for forward bracket 24 and one for rearward bracket 26. Fastener shoulders 46 are disposed adjacent the heads of frame fasteners 42. The diameter of fastener shoulders 46 is only slightly smaller than the width of bracket slots 30, as fastener shoulders 46 are engaged within slots 30 when in use. Threaded shafts 48 project upwardly from fastener shoulders 46 to threadably engage base fasteners 44. Base fasteners 44 include heads 50 and threaded sleeves 52. Threaded shafts 48 threadably engage the threaded bores of sleeves 52. Two base fasteners 44 are used in the preferred embodiment illustrated in FIG. 2, one in each of base slots 32 and 34. Heads 50 of base fasteners 44 are disposed at the upper ends of sleeves 52. Heads 50 are oriented in horizontal planes within slots 32 and 34 while sleeves 52 are generally perpendicular to heads 50. Heads 50 have flat surfaces on their forward and rearward sides such that they can nonrotatably, yet slidably, engage within slots 32 and 34.

As mentioned above, slots 32 and 34 are similar except for the length of slots 32 and 34, forward slot 32 generally being longer than rearward slot 34. Slots 32 and 34 have slotted plates 54 molded within them. Slotted plates 54 are preferably constructed of aluminum, although other materials of comparable strength, preferably of light weight, may alternatively be used. This construction provides for decreased wear and resistance to deformation upon the tightening of fasteners 42 and 44. Slotted plate 54 is nested between a narrow slot portion 56 and a wide slot portion 58. The outside perimeters of slotted plates 54 are within the outside perimeters of ridges 36 and 38. Narrow slot portion 56 is disposed beneath slotted plate 54 and has a bottom rim defined by ridges 36 and 38 of forward and rearward base slots 32 and 34, respectively. The width of narrow slot portion 56 is slightly larger than the diameter of sleeve 52 of base fasteners 44. The width of the slot within slotted plate 54 is slightly smaller than the width of narrow slot portion 56. The width of wide slot portion 58 is slightly larger than the narrowest transverse portion of head 50 of base fastener 44. The narrowest portion of head 50 is defined as that between the flat surfaces on the forward and rearward sides of head 50. The width of wide slot portion 58 is narrower than the widest width or diameter of head 50. This arrangement provides for a nonrotatable engagement of head 50 within wide slot portion 58. The bottom surface of head 50 rides upon slotted plate 54.

A slot shoulder 60 is formed around the top of the perimeter of wide slot portion 58. Forward and rearward slot covers 62 and 64 are provided to fit over forward and rearward base slots 32 and 34 upon slot shoulders 60. Thus, the shape of forward and rearward slot shoulders 62 and 64 match the outer shape of slot shoulders 60, i.e., oblong oval shapes. The thickness of forward and rearward slot covers are such that a generally smooth top surface of base 18 is provided with forward and rearward slot covers 62 and 64 in place. The thickness of wide slot portion 58 is slightly greater than the thickness of heads 50 of base fasteners 44 such that base fasteners 44 are free to slide back and forth within forward and rearward base slots 32 and 34 when not tightened to frame fasteners 42.

With the above construction in an assembled configuration, as illustrated in FIG. 3, base slots 32 and 34 are disposed directly above and transverse to the longitudinal axis of bracket slots 30. This arrangement allows for a wide range of longitudinal or lateral adjustments or a combination of both depending upon the preferences of the individual skater. Adjustment is accomplished by loosening frame fasteners 42. While frame fasteners 42 are loosened, base fasteners 44 are not allowed to turn, since the flat sides of heads 50 are restrained by wide slot portion 58. Thus, loosening can be accomplished with only one tool. Once fasteners 42 and 44 are loosened, longitudinal and lateral adjustment is made, after which fasteners 42 and 44 are again tightened together. The tightening of fasteners 42 and 44 creates enough friction between the top surface of brackets 24 and 26 and the bottom surface of ridges 36 and 38 so that movement of one with respect to other is not permitted.

Figure 4:
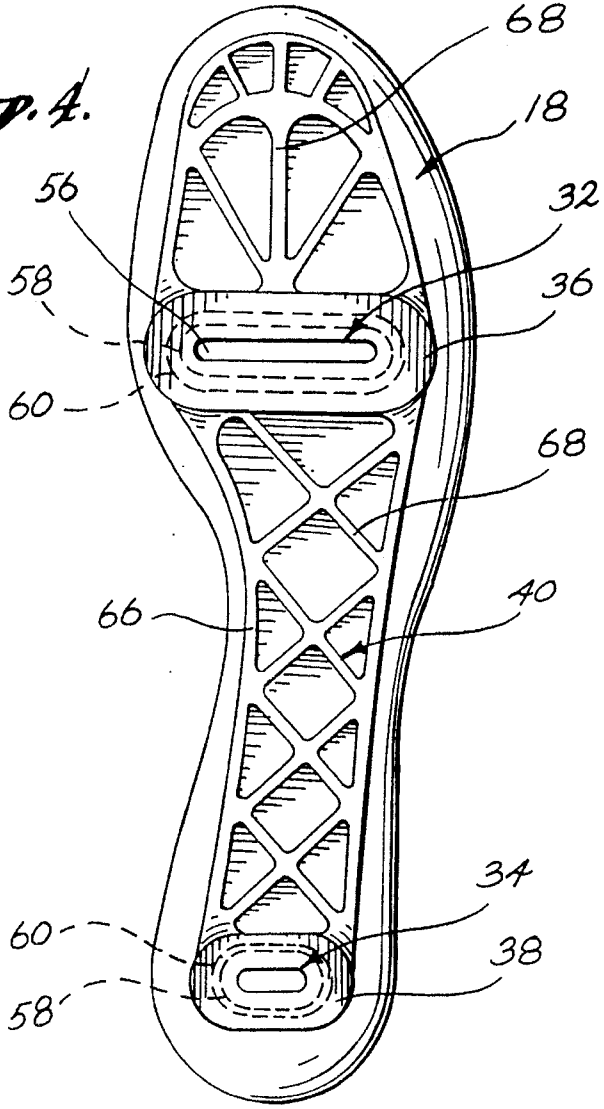
FIG. 4 is a bottom view of the base of one embodiment of a skate shoe made according to the present invention.

FIG. 4 illustrates the preferred configuration of base support ribs 40. Base support ribs 40 include a peripheral rib 66 that extends around base 18, inward of the outside contours of base 18. Peripheral rib 66 extends around the perimeter of base 18 near the outer edges of base 18. Cross ribs 68 form cross patterns within peripheral rib 66 between forward ridge 36 and rearward ridge 38. Cross ribs 68 extend radially forward of forward ridge 36 from a point at about the middle of the forward side of forward ridge 36. Ribs 66 and 68 provide torsional, longitudinal, and lateral structural support to base 18 while not adding significantly to the weight of base 18.

Figure 5:
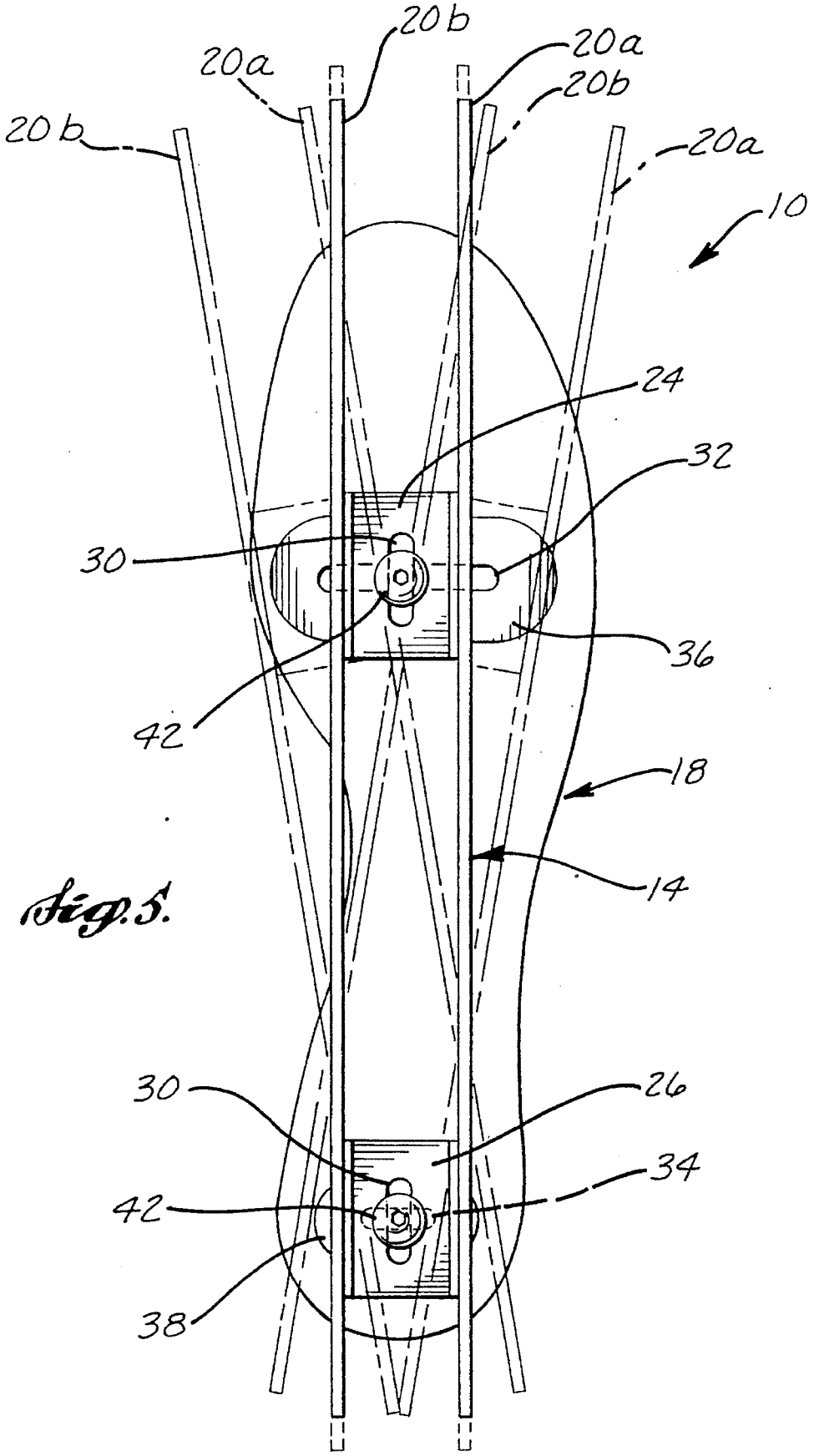
FIG. 5 is a bottom view of the in-line skate of the present invention with the wheels removed illustrating the range of adjustability of the frame rails relative to the base of the shoe.

FIG. 5 illustrates some of the range of adjustability of frame 14 relative to base 18. The skater may wish to have an extreme toe-in configuration or an extreme toe-out configuration. Side-to-side adjustability is also possible with both the forward and rearward portions of frame 14 being adjusted outwardly or inwardly (not shown in FIG. 5). Longitudinal adjustment is provided alone or in combination with the lateral adjustability. Longitudinal adjustment is provided by bracket slots 30. Those skilled in the art will appreciate that longer slots 30 could also be employed to provide for a greater degree of longitudinal adjustability. Because of the combination of slots described above, the options to the skater are greatly increased over prior art designs. Frame 14 may be adjusted in any horizontal direction relative to base 18 of shoe 12. In particular, the long transverse length of forward base slot 32 formed as a portion of base 18 greatly adds to the adjustability options of the skate.

Figure 6:
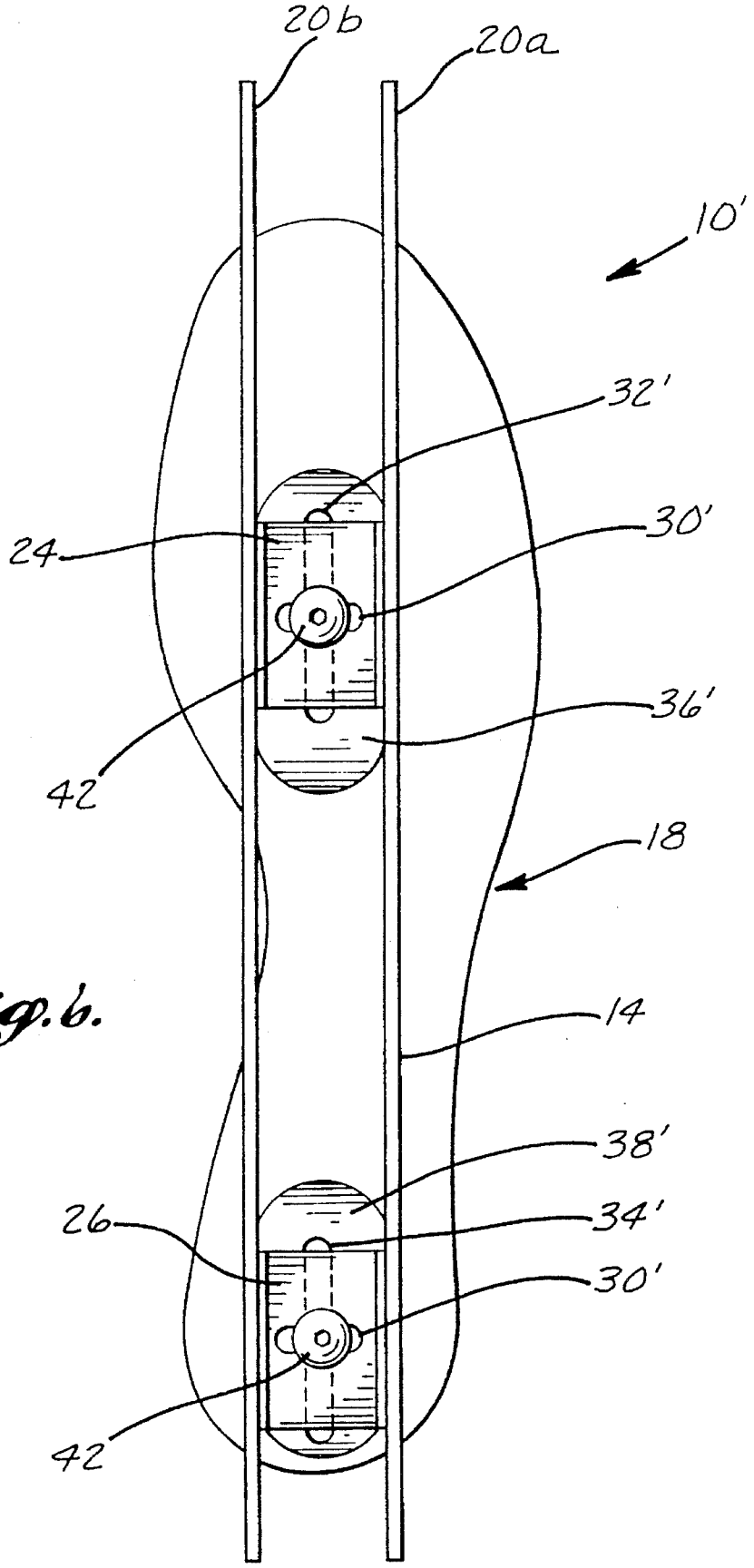
FIG. 6 is a bottom view of an alternate embodiment of the present invention.

FIG. 6 illustrates an alternate embodiment of skate 10'. In this embodiment, forward and rearward base slots 32' and 34' are oriented with their longitudinal axes parallel to the longitudinal axis of skate 10'. Also in this embodiment, bracket slots 30' are oriented perpendicular to the longitudinal axis of frame 14. The construction of skate 10 is otherwise the same as that described above. Thus, with this alternate construction, similar adjustability is provided to the preferred embodiment previously described. Longitudinal adjustment is allowed by loosening and movement of fasteners 42 and 44 within base slots 32' and 34'. Lateral adjustment is allowed by loosening and movement of fasteners 42 and 44 within bracket slots 30'.

While the preferred embodiments of the invention have been illustrated and described, it will be appreciated that various changes can be made therein without departing from the spirit and scope of the invention.

The embodiments of the invention in which an exclusive property or privilege is claimed are defined as follows:

1. A skate having a longitudinal axis, said skate comprising:

(a) a shoe including a base forming the bottom thereof, the base having a first rim and first and second base fasteners, the first rim forming a first base slot, the first base fastener being slidable within the first base slot when loosened, the first and second base fasteners being spaced apart along the longitudinal axis; and (b) a rigid frame adapted for securing wheels, coupled to said base, said frame having first and second frame fasteners adapted to engage the first and second base fasteners, respectively, tight engagement of the base fasteners to the frame fasteners precluding sliding of the first base fastener within the first base slot, wherein said frame further comprises first and second brackets having first and second frame slots oriented generally transversely to said first base slot, respectively, the first and second frame fasteners being engaged with the first and second brackets, respectively.

2. The skate of claim 1, wherein said base further comprises a second rim forming a second base slot longitudinally spaced from the first base slot, the second base fastener being slidable within the second base slot.

3. The skate of claim 1, wherein the first and second base slots each include a narrow slot portion and a wide slot portion, the narrow slot portion being below the wide slot portion, and wherein the first and second base fasteners include head portions that are nonrotatably engaged within the wide slot portions of the first and second base slots, respectively.

4. The skate of claim 3, wherein said base further comprises slotted plates disposed within each of the first and second base slots and forming at least part of the narrow portions of the base slots, the head portions of the base fasteners being disposed on said slotted plates, the slotted plates being constructed of a material that resists deformation better than the surrounding material of the base such that the head portions of the base fasteners are retained within the base slots on said slotted plates.

5. The skate of claim 3, wherein said base includes a support structure projecting from the bottom of the base to increase the torsional stiffness of the base, and wherein said base also includes first and second ridges projecting from the bottom of the base, the first ridge forming the first rim, the second ridge forming a second rim.

6. A skate having a longitudinal axis, said skate comprising:

(a) a shoe including a base forming the bottom thereof, the base having a first rim and first and second base fasteners, the first rim forming a first base slot, the first base fastener being slidable within the first base slot when loosened, the first and second base fasteners being spaced apart along the longitudinal axis; and (b) a rigid frame adapted for securing wheels, coupled to said base, said frame having first and second frame fasteners adapted to engage the first and second base fasteners, respectively, tight engagement of the base fasteners to the frame fasteners precluding sliding of the first base fastener within the first base slot, wherein the first base slot includes a narrow slot portion and a wide slot portion above the narrow slot portion, the first base fastener including a head portion that is nonrotatably engaged within the wide slot portion of the first base slot.

7. The skate of claim 6, wherein said base further comprises a slotted plate disposed within the first base slot and forming at least part of the narrow portion of the first base slot, the head portion of the first base fastener being disposed on the slotted plate, the slotted plate being constructed of a material that resists deformation better than the surrounding material of the base such that the head portion of the first base fastener is retained within the first base slot and does not deform the slot when secured to the first frame fastener.

8. A skate having a longitudinal axis, said skate comprising:

(a) a shoe including a base forming the bottom thereof, the base having a first rim and first and second base fasteners, the first rim forming a first base slot, the first base fastener being slidable within the first base slot when loosened, the first and second base fasteners being spaced apart along the longitudinal axis; and (b) a rigid frame adapted for securing wheels, coupled to said base, said frame having first and second frame fasteners adapted to engage the first and second base fasteners, respectively, tight engagement of the base fasteners to the frame fasteners precluding sliding of the first base fastener within the first base slot, wherein said base includes a cross-ribbed support structure projecting from its bottom surface to increase the torsional stiffness of the base.

9. A skate comprising:

(a) a shoe including a base forming the bottom thereof, the base including a longitudinal axis, a first rim and first and second base fasteners spaced apart along the longitudinal axis of the base, the first rim forming a first transverse slot, the first base fastener being transversely slidable within the first transverse slot when loosened; and (b) a frame adapted for securing wheels coupled to said base, said frame having first and second longitudinal slots and first and second frame fasteners slidably engaged within the first and second longitudinal slots, respectively, the first and second frame fasteners being engaged with the first and second base fasteners, respectively.

10. The skate of claim 9, wherein said base further comprises a second rim forming a second transverse slot longitudinally spaced from the first transverse slot, the second base fastener being slidable within the second transverse slot.

11. The skate of claim 10, wherein the first and second transverse slots each include a narrow slot portion and a wide slot portion having a greater width than the narrow slot portion, the narrow slot portion being disposed below the wide slot portion, and wherein the first and second base fasteners include head portions that are nonrotatably engaged within the wide slot portions of the first and second transverse slots, respectively.

12. The skate of claim 11, wherein said base includes a cross-ribbed support structure projecting from its bottom surface to increase the torsional stiffness of the base.

13. A skate comprising:

(a) a shoe including a base forming the bottom thereof, the base having first and second longitudinal slots and first and second base fasteners spaced longitudinally along the base, the first base fastener being slidable within the first longitudinal slot and the second base fastener being slidable within the second longitudinal slot; and (b) a frame adapted for securing wheels coupled to said base, said frame having first and second transverse slots and first and second frame fasteners slidably engaged within the first and second transverse slots, respectively, the first and second frame fasteners being engaged with the first and second base fasteners, respectively.

14. The skate of claim 13, wherein the first and second longitudinal slots each include a narrow slot portion and a wide slot portion having a greater width than the narrow slot portion, the narrow slot portion being disposed below the wide slot portion, and wherein the first and second base fasteners include head portions that are nonrotatably engaged within the wide slot portions of the first and second longitudinal slots, respectively.

15. The skate of claim 14, wherein said base includes a cross-ribbed support structure projecting from its bottom surface to increase the torsional stiffness of the base.

16. A skate having a longitudinal axis, the skate comprising:

(a) a base having a first rim and a second rim and first and second base fasteners, the first and second rims forming first and second base slots, respectively, the first and second base fasteners being slidable within the first and second base slots, respectively, when loosened, the first and second base fasteners being spaced apart along the longitudinal axis; and (b) a frame coupled to said base, said frame having first and second frame fasteners adapted to engage the first and second base fasteners, respectively, tight engagement of the base fasteners to the frame fasteners precluding sliding of the first and second base fasteners within the first and second base slots, respectively, wherein said frame further comprises first and second brackets having first and second frame slots oriented generally transversely to said first and second base slots, respectively, the first and second frame fasteners being engaged with the first and second brackets, respectively.

17. The skate of claim 16, wherein the first and second base slots each include a narrow slot portion and a wide slot portion, the narrow slot portion being below the wide slot portion, and wherein the first and second base fasteners include head portions that are nonrotatably engaged within the wide slot portions of the first and second base slots, respectively.

18. The skate of claim 17, wherein said base further comprises slotted plates disposed within each of the first and second base slots and forming at least part of the narrow portions of the base slots, the head portions of the base fasteners being disposed on said slotted plates, the slotted plates being constructed of a material that resists deformation better than the surrounding material of the base such that the head portions of the base fasteners are retained within the base slots on said slotted plates.

19. A skate comprising:

(a) a base including first and second rims and first and second base fasteners, the first and second rims forming first and second transverse slots, respectively, spaced longitudinally along the base of the skate, the first and second base fasteners being transversely slidable within the first and second transverse slots; and (b) a frame coupled to said base, said frame having first and second longitudinal slots and first and second frame fasteners slidably engaged within the first and second longitudinal slots, respectively, the first and second frame fasteners being engaged with the first and second base fasteners, respectively.

20. The skate of claim 19, wherein the first and second transverse slots each include a narrow slot portion and a wide slot portion having a greater width than the narrow slot portion, the narrow slot portion being disposed below the wide slot portion, and wherein the first and second base fasteners include head portions that are nonrotatably engaged within the wide slot portions of the first and second transverse slots, respectively.

21. The skate of claim 20, wherein said base includes a cross-ribbed support structure projecting from its bottom surface to increase the torsional stiffness of the base.

22. A skate comprising:

(a) a base having first and second longitudinal slots and first and second base fasteners, the first base fastener being slidable within the first longitudinal slot and the second base fastener being slidable within the second longitudinal slot, wherein the first and second longitudinal slots each include a narrow slot portion and a wide slot portion having a greater width than the narrow slot portion, the narrow slot portion being disposed below the wide slot portion, and wherein the first and second base fasteners include head portions that are nonrotatably engaged within the wide slot portions of the first and second longitudinal slots, respectively; and (b) a frame coupled to said base, said frame having first and second transverse slots and first and second frame fasteners slidably engaged within the first and second transverse slots, respectively, the first and second frame fasteners being engaged with the first and second base fasteners, respectively.

23. The skate of claim 22, wherein said base includes a cross-ribbed support structure projecting from its bottom surface to increase the torsional stiffness of the base.

* * * * *

UNITED STATES PATENT AND TRADEMARK OFFICE

CERTIFICATE OF CORRECTION

PATENT NO. : 5,452,907

DATED : September 26, 1995

INVENTOR(S) : A.A. Meibock et al.

It is certified that error appears in the above-indentified patent and that said Letters Patent is hereby corrected as shown below:

| COLUMN | LINE | |
|---|---|---|
| [56] | Refs. Cited Other Pubs. | Insert --13 Photographs of Viking ice skate. Skate in use in U.S. before priority date of present application.-- |
| 6 (Claim 3, | 59 line 1) | "1," should read --2,-- |

Signed and Sealed this

Sixteenth Day of January, 1996

Bruce Lehman

*Attest:*

BRUCE LEHMAN

*Attesting Officer*

*Commissioner of Patents and Trademarks*